US006307478B1

(12) United States Patent
Thompson

(10) Patent No.: US 6,307,478 B1
(45) Date of Patent: Oct. 23, 2001

(54) MULTI-ZONE GAS DETECTION SYSTEM

(76) Inventor: Nat Thompson, 33-44 102nd St., Coronal, NY (US) 11368

( * ) Notice: Subject to any disclaimer, the term of this patent is extended or adjusted under 35 U.S.C. 154(b) by 0 days.

(21) Appl. No.: 09/746,244

(22) Filed: Dec. 23, 2000

(51) Int. Cl.[7] ..... G08B 17/00

(52) U.S. Cl. ..... 340/632; 340/627; 340/693.5; 340/641

(58) Field of Search ..... 340/632, 627, 340/521, 634, 640, 643, 506, 641, 693.5

(56) References Cited

U.S. PATENT DOCUMENTS

| | | | | |
|---|---|---|---|---|
| 3,678,487 | * | 7/1972 | Ludewig | 340/632 |
| 4,236,822 | * | 12/1980 | Jaretsky et al. | 356/256 |
| 4,257,039 | * | 3/1981 | Webb et al. | 340/629 |
| 4,308,911 | * | 1/1982 | Mandl | 340/588 |
| 4,390,869 | * | 6/1983 | Christen et al. | 340/632 |
| 4,764,758 | * | 8/1988 | Skala | 340/632 |
| 5,126,934 | * | 6/1992 | MacFadyen | 364/140 |
| 5,462,114 | * | 10/1995 | Catanese, Jr. | 166/53 |

* cited by examiner

*Primary Examiner*—Jeffery Hofsass
*Assistant Examiner*—Daniel Previ

(57) ABSTRACT

A gas detection system for use in multiple zones. The system includes a plurality of gas sensor assemblies, a central control, and an alarm. The alarm includes a plurality of indicator lights that are disposed at the central control, with a respective indicator light being in electrical communication with an associated gas sensor so as to allow the respective indicator light to illuminate when the associated gas sensor detects the gas and provide a visible alarm that is detected from a central location remote from the plurality of gas sensor assemblies, and a sound generator that is disposed at each sensor assembly, with a respective sound generator being in electrical communication with an associated gas sensor so as to allow the respective sound generator to activate when the associated gas sensor detects the gas and provide an audible alarm that is detected at the associated gas sensor. The central control includes an internal test circuit that periodically tests operation of the gas sensors, and if the test fails, activates the alarm, and an internal ventilator circuit that is operatively connected to and turns on a ventilation system in a zone when an associated gas sensor detects the gas.

11 Claims, 2 Drawing Sheets

MULTI-ZONE GAS DETECTION SYSTEM

CROSS REFERENCE TO RELATED APPLICATIONS

The instant application is a refile of application Ser. No. 09/305,227, filed on May 3, 1999, entitled MULTI-ZONE GAS DETECTION SYSTEM, and now abandoned.

BACKGROUND OF THE INVENTION

1. Field of the Invention

The present invention relates to a gas detection system. More particularly, the present invention relates to a multi-zone gas detection system.

2. Description of the Prior Art

Numerous innovations for gas detectors have been provided in the prior art that will be described. Even though the[]se. innovations may be suitable for the specific individual purposes to which they address, however, they differ from the present invention in that they do not teach a multi-zone gas detection system.

FOR EXAMPLE, U.S. Pat. No. 5,280,273 to Goldstein teaches a detector system for sensing the presence of a toxic gas, such as carbon monoxide, and sounding an alarm. The presence of the gas is detected by passing light through a bimetallic sensing material that darkens in the presence of the gas. The system includes a housing containing a light emitter, a light detector and a mechanism for sounding an alarm. The sensing material is contained in a cell, which, together with a battery to power the system, are mounted in a drawer insertable into the housing, which has openings permitting ambient air to reach the sensing material. When fully inserted, the drawer positions the cell between the emitter and detector and brings battery contacts into connection with contacts for the light emitter and alarm. Both the battery and sensing material must be replaced periodically, typically about once every three years. The drawer is configured so that it cannot be inserted without a battery in place. Both the battery and cell are easily replaced in the drawer. A micro porous filter is preferably placed between the cell and ambient air to prevent contamination by large airborne particles.

ANOTHER EXAMPLE, U.S. Pat. No. 5,184,500 to Krema et al. teaches a battery-powered detector that comprises a gas sensor coupled to a current source and a power supply. The power supply generates a relatively high voltage when the gas sensor is warming up and a relatively low voltage after the sensor has warmed up.

The gas sensor, which is responsive to the presence of a gas, is coupled to an amplifier having a variable sensitivity circuit. The amplifier is connected to a microprocessor that determines the concentration of the sensed gas and provides a visual indication of the concentration on a display. The gas detector can sense the presence of a variety of different gases. The gas concentration of the sensed gas is determined based upon the magnitudes of a gas sensing signal generated by the amplifier, a calibration signal generated during a calibration routine, when the detector is in a controlled environment, and an error signal generated when the detector is in a no-gas environment.

STILL ANOTHER EXAMPLE, U.S. Pat. No. 4,219,806 to Enemark teaches a detector of a significant gas condition in the atmosphere that comprises one or more elements for sensing the condition, the elements being connected to an alarm channel which sounds a warning alarm or controls a corrective device such as a gas valve in the event of an excessive atmospheric condition. The detector includes a threshold sensing and alarm amplifying channel, and a trouble sensing electronic valve or stage responsive to failure of one of the sensing elements both to enable operation of a trouble channel to cause the alarm to indicate the failure and also to inhibit operation of the warm channel. The trouble channel may also relay power supply failures such as a decrease in battery voltage.

YET ANOTHER EXAMPLE, U.S. Pat. No. 4,083,226 to Eckstein et al. teaches a portable explosion-proof gas detection device that comprises a housing which defines an interior flameproof motor chamber with an electric motor in the chamber having a power drive shaft which extends outwardly into a pump chamber having a rotor connected to the electric motor shaft. The rotor engages a hose connection which is arranged in an openable chamber and which is engaged by a rotor over a pump squeezing surface defined by the housing surrounding wall. The hose is connected through a twin fitting to a holder for a testing tube which has an opening at each end and is positionable in a tube holder so that its open end is oriented in an opening in the housing for the inflow of air through the tube and through the pump for discharge out of the housing. The apparatus includes a control knob which actuates an electrical control circuit which is magnetically actuable by rotation of the knob to energize the electric motor from a battery source which is also within the housing. The housing includes a cover which includes an end and a top wall portion which, when fitted upwardly, provides an access to the contact tube holder and also to the pump fitting to permit the replacement thereof, if necessary.

FINALLY, STILL YET ANOTHER EXAMPLE, U.S. Pat. No. 4,045,729 to Loh teaches a gas detector for sensing the presence of a gaseous medium consisting of a helical coil for connection to a dc power source for generating both an electromagnetic field and radiant heat. The coil is wrapped around a tubular sleeve constructed of a sensing material, such as a semiconductor, and disposed in the magnetic and heating fields of the coil. An electrode is disposed in the sleeve so that when a current sensing medium is connected between the electrode and one end of the rod, a current will be produced proportionally to the concentration of the gas being detected. In several embodiments, the sleeve is constructed of an n-type semiconductor material, such as zinc oxide, stannic oxide, or gallium oxide and is for detecting hydrocarbons. If the sleeve is constructed of tungsten trioxide or molybdenum mixed with silicon dioxide, the sleeve can be used for detecting hydrogen. The sleeve is generally operated at temperatures between 100 deg. and 450 deg. C. An additional battery can be coupled between the current sensing element and one end of the coil for increasing the sensitivity of the sleeve.

It is apparent that numerous innovations for gas detectors have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a multi-zone gas detection system that avoids the disadvantages of the prior art.

ANOTHER OBJECT of the present invention is to provide a multi-zone gas detection system that is simple and inexpensive to manufacture.

STILL ANOTHER OBJECT of the present invention is to provide a multi-zone gas detection system that is simple to use.

BRIEFLY STATED, YET ANOTHER OBJECT of the present invention is to provide a gas detection system for use in multiple zones. The system includes a plurality of gas sensor assemblies, a central control, and an alarm. The alarm includes a plurality of indicator lights that are disposed at the central control, with a respective indicator light being in electrical communication with an associated gas sensor so as to allow the respective indicator light to illuminate when the associated gas sensor detects the gas and provide a visible alarm that is detected from a central location remote from the plurality of gas sensor assemblies, and a sound generator that is disposed at each sensor assembly, with a respective sound generator being in electrical communication with an associated gas sensor so as to allow the respective sound generator to activate when the associated gas sensor detects the gas and provide an audible alarm that is detected at the associated gas sensor. The central control includes an internal test circuit that periodically tests operation of the gas sensors, and if the test fails, activates the alarm, and an internal ventilator circuit that is operatively connected to and turns on a ventilation system in a zone when an associated gas sensor detects the gas.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
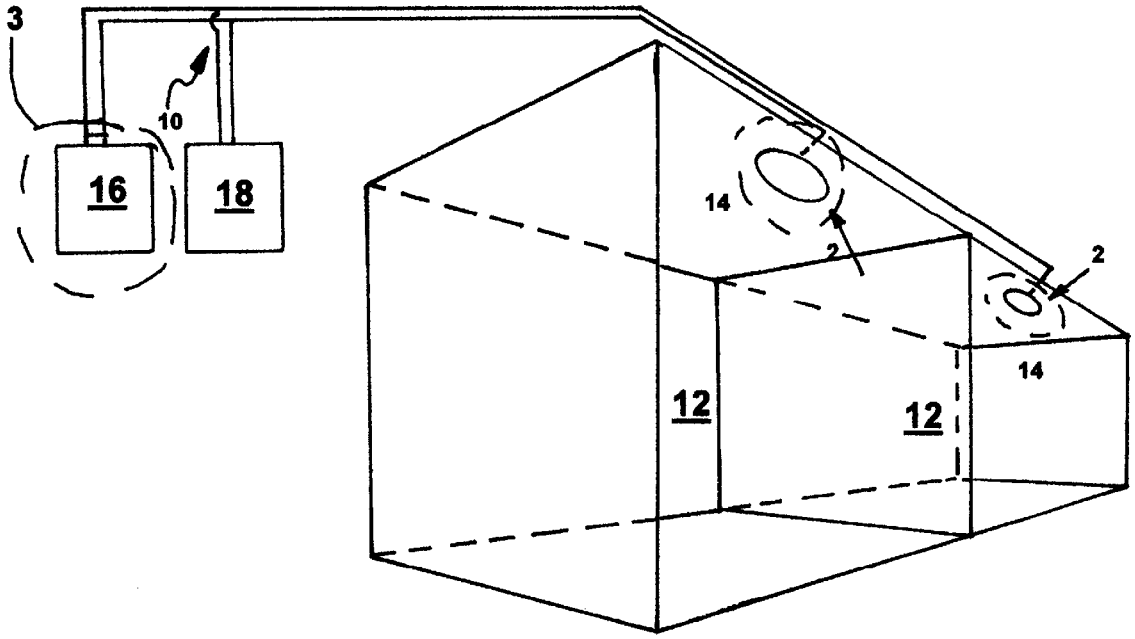
FIG. 1 is a diagrammatic perspective view of the present invention in use.

10 gas detection system for use in multiple zones of the present invention
12 multiple zones
14 plurality of gas sensor assemblies for placing in multiple zones 12 and for detecting gas thereat
15 ceiling
16 central control
18 alarm
20 sensor housing of each gas sensor assembly of plurality of gas sensor assemblies 14
22 sensor upper terminal surface of sensor housing 20 of each gas sensor assembly of plurality of gas sensor assemblies 14 for contacting ceiling 15
24 sensor lower terminal surface of sensor housing 20 of each gas sensor assembly of plurality of gas sensor assemblies 14
26 sensor side wall of sensor housing 20 of each gas sensor assembly of plurality of gas sensor assemblies 14
28 plurality of side vents in sensor side wall 26 of sensor housing 20 of each gas sensor assembly of plurality of gas sensor assemblies 14 for receiving gas
30 side grill of sensor side wall 26 of sensor housing 20 of each gas sensor assembly of plurality of gas sensor assemblies 14 for preventing entrance of undesirable objects therethrough
32 plurality of bottom vents in sensor lower terminal surface 24 of sensor housing 20 of each gas sensor assembly of plurality of gas sensor assemblies 14 for receiving gas.
34 bottom grill of sensor lower terminal surface 24 of sensor housing 20 of each gas sensor assembly of plurality of gas sensor assemblies 14 for preventing entrance of undesirable objects therethrough
36 gas sensor of each gas sensor assembly of said plurality of gas sensor assemblies 14 for detecting gas.
38 control housing of central control 16
40 front face of control housing 38 of central control 16
42 plurality of indicator lights of alarm 18
44 indicia of alarm 18
46 sound generator of alarm 18
48 internal test circuit of central control 16
50 internal ventilator circuit of central control 16 for operatively connecting to and turning on ventilation system 52 in zone 12 when associated gas sensor 36 detects gas
52 ventilation system in zone 12
54 battery
56 first apparatus for being operatively connected to gas main valve 57 and closing gas main valve 57 when alarm 18 is activated so as to prevent any more gas from escaping.
57 gas main valve.
58 second apparatus for being operatively connected to telephone communication line 59 and automatically dialing out distress call when alarm 18 is activated so as to facilitate corrective action.
59 telephone communication line.

DETAILED DESCRIPTION OF THE PREFERRED EMBODIMENT

Referring now to the figures, in which like numerals indicate like parts, and particularly to FIG. 1, which is a diagrammatic perspective view of the present invention in use, the gas detection system for use in multiple zones of the present invention is shown generally at 10 for use in multiple zones 12.

The overall configuration of the gas detection system for use in multiple zones 10 can best be seen in FIG. 1, which is again a diagrammatic perspective view of the present invention in use, and as such, will be discussed with reference thereto.

The gas detection system for use in multiple zones 10 comprises a plurality of gas sensor assemblies 14 for placing in the multiple zones 12 and for detecting gas thereat.

The gas detection system for use in multiple zones 10 further comprises a central control 16 operatively connected to the plurality of gas sensor assemblies 14.

The gas detection system for use in multiple zones 10 further comprises an alarm 18 responsive to any of the plurality of gas sensor assemblies 14 detecting the gas.

Figure 2:
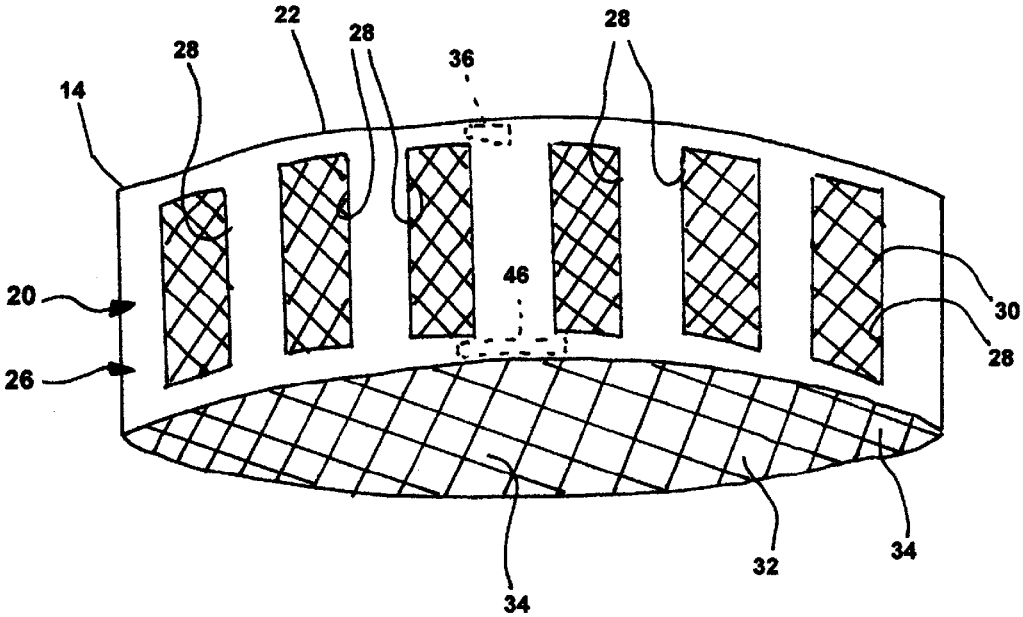
FIG. 2 is an enlarged diagrammatic perspective view of the area generally enclosed by the dotted curve identified by ARROW 2 in FIG. 1 of a gas sensor assembly of the present invention.

The specific configuration of each gas sensor assembly 14 can best be seen in FIG. 2, which is an enlarged diagrammatic perspective view of the area generally enclosed by the dotted curve identified by ARROW 2 in FIG. 1 of a gas sensor assembly of the present invention, and as such, will be discussed with reference thereto.

Each gas sensor assembly 14 is for mounting on a ceiling 15, since the gas is lighter than air and rises.

Each gas sensor assembly 14 comprises a sensor housing 20.

The sensor housing 20 is thin and cylindrically-shaped, and has a sensor upper terminal surface 22 that is substantially flat and circular-shaped for contacting the ceiling 15, a sensor lower terminal surface 24 that is substantially flat and circular-shaped, and a sensor side wall 26 that is ring-shaped and extends from the sensor upper terminal surface 22 to the sensor lower terminal surface 24.

The sensor side wall 26 has a plurality of side vents 28 that extend therethrough for receiving the gas.

The sensor side wall 26 further has a side grill 30 that is gas permeable and covers the plurality of side vents 28 for preventing entrance of undesirable objects therethrough.

The sensor lower terminal surface 24 has a plurality of bottom vents 32 that extend therethrough for receiving the gas.

The sensor lower terminal surface 24 further has a bottom grill 34 that is gas permeable and covers the plurality of bottom vents 32 for preventing entrance of undesirable objects therethrough.

Each gas sensor assembly 14 further comprises a gas sensor 36 that is disposed in the sensor housing 20 for detecting the gas.

Figure 3:
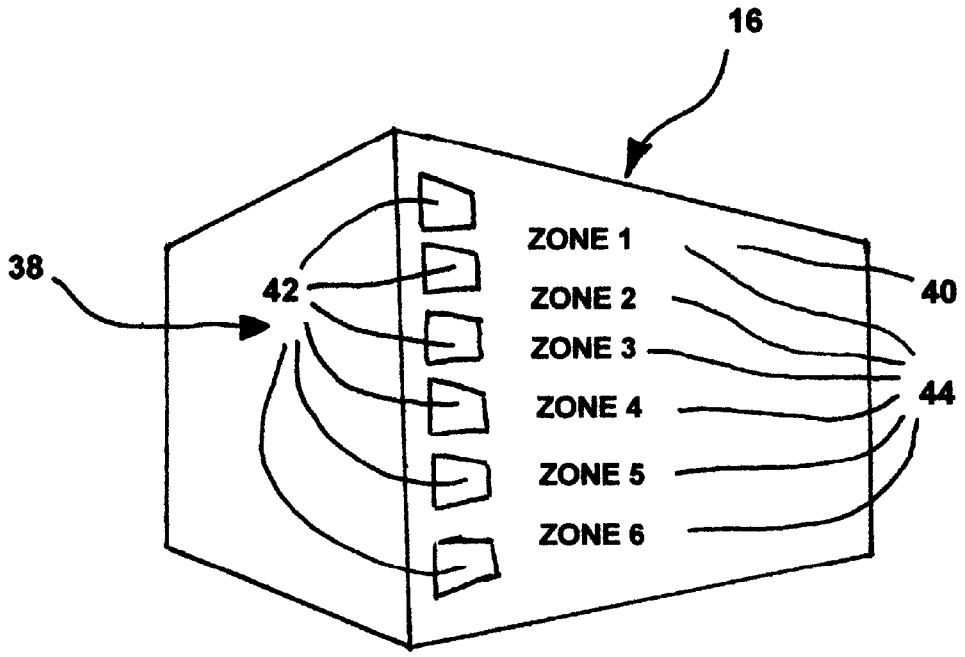
FIG. 3 is an enlarged diagrammatic perspective view of the area generally enclosed by the dotted curve identified by ARROW 3 in FIG. 1 of a central control of the present invention.

The specific configuration of the central control 16 can best be seen in FIG. 3, which is an enlarged diagrammatic perspective view of the area generally enclosed by the dotted curve identified by ARROW 3 in FIG. 1 of a central control of the present invention, and as such, will be discussed with reference thereto. central control 16 comprises a control housing 38 that has a front face 40.

The specific configuration of the alarm 18 can best be seen :in FIGS. 2 and 3, which are again, respectively, an enlarged diagrammatic perspective view of the area generally enclosed by the dotted curve identified by ARROW 2 in FIG. 1 of a gas sensor assembly of the present invention, and an enlarged diagrammatic perspective view of the area generally enclosed by the dotted curve identified by ARROW 3 in FIG. 1 of a central control of the present invention, and as such, will be discussed with reference thereto.

The alarm 18 comprises a plurality of indicator lights 42 that are disposed on the front face 40 of the control housing 38, with a respective indicator light 42 being in electrical communication with an associated gas sensor 36 so as to allow the respective indicator light 42 to illuminate when the associated gas sensor 36 detects the gas and provide a visible alarm that is detected from a central location remote from the plurality of gas sensor assemblies 14.

The alarm 18 further comprises indicia 44 that is disposed along side the plurality of indicator lights 42 and associates the respective indicator light 42 with the associated gas sensor assembly 14 so as to allow identification of which zone 12 the gas has been detected in.

The alarm 18 further comprises a sound generator 46 that is disposed on the sensor lower terminal surface 24 of each sensor housing 20, with a respective sound generator 46 being in electrical communication with an associated gas sensor 36 so as to allow the respective sound generator 46 to activate when the associated gas sensor 36 detects the gas and provide an audible alarm that is detected at the associated gas sensor 36.

The alarm 18 further comprises first apparatus 56 for being operatively connected to a gas main valve 57 and closing the gas main valve 58 when the alarm 18 is activated so as to prevent any more gas from escaping.

Such apparatus is typically taught by U.S. Pat. No. 4,219,806 to Enemark, and as such, is incorporated herein by reference thereto so that its teachings supplement the instant disclosure, as was allowed in the recent decision in Robotic Vision Systems, Inc. v. *View Engineering*, Inc., 112 F.3d 1163, 42 USPQ.2d 1619 (Fed. Cir. 1997), where the Court held:

"Knowledge of a skilled artisan may supplement the disclosure."

[Emphasis added]

And, in Young Dental Manufacturing Company, Inc. v. Q3 Special Products, Inc., 112 F.3d 1137, 42 USPQ.2d 1589 (Fed. Cir. 1997), where the Court held:

"An inventor must only disclose information that would not have been apparent to a skilled artisan."

[Emphasis added]

And, in Genentech, Inc. v. Novo Nordisk, Als, 108 F.3d 1361, 42 USPQ.2d 1001 (Fed. Cir. 1997), where it was held:

"A specification need not disclose what is well known in the art."

[Emphasis added]

The alarm 18 further comprises second apparatus 58 for being operatively connected to a telephone communication line 59 and automatically dialing out a distress call when the alarm 18 is activated so as to facilitate corrective action.

Figure 4:
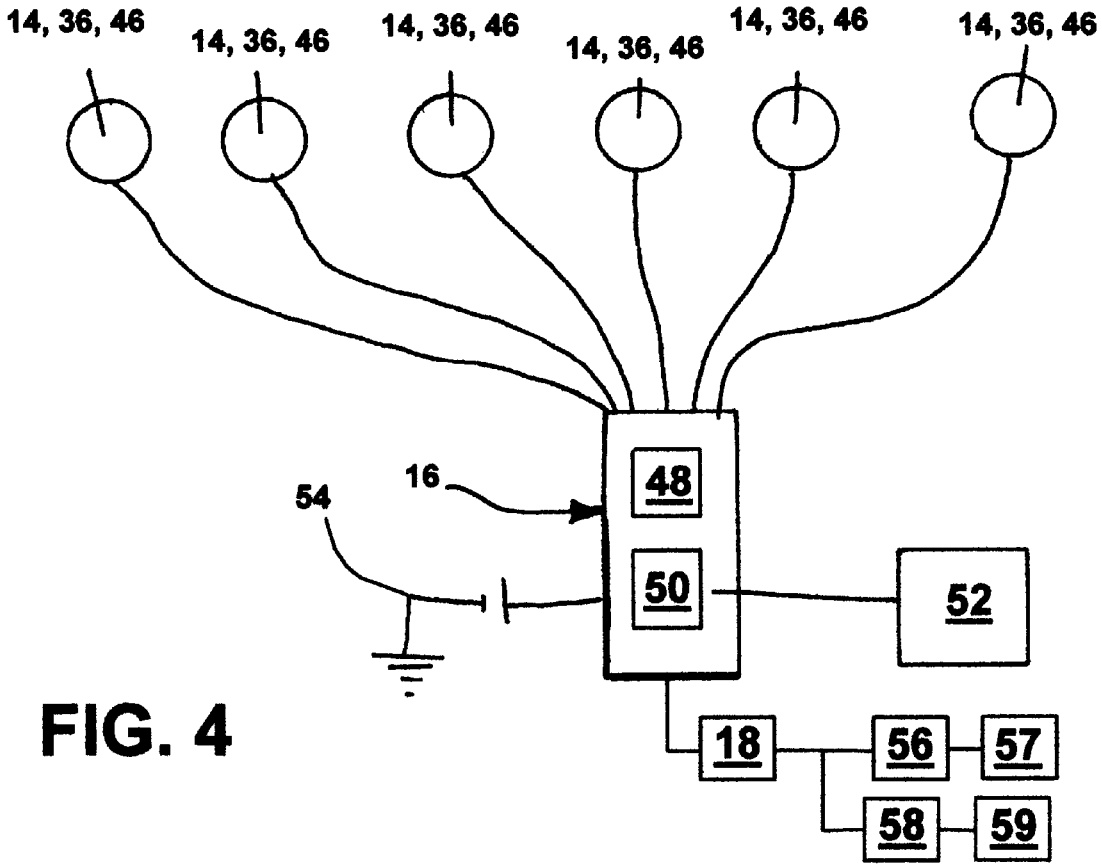
FIG. 4 is a block diagram of the present invention.

As shown in FIG. 4, which is a block diagram of the present invention, the central control 16 further comprises an internal test circuit 48 that periodically tests operation of the gas sensors 36, and if the test fails, activates an associated sound generator 46. Typically, the internal test circuit 16 can be adapted from the teachings of U.S. Pat. No. 4,219,806 to Enemark, which is incorporated herein by reference thereto.

The central control 16 further comprises an internal ventilator circuit 50 for operatively connecting to and turning on a ventilation system 52 in a zone 12 when an associated gas sensor 36 detects the gas. Typically, the ventilator circuit 50 can be adapted from the teachings of U.S. Pat. No. 4,197,675 to Kelly, which is incorporated herein by reference thereto.

The multi-zone gas detection system is for being powered by a battery 54.

It will be understood that each of the elements described above, or two or more together, may also find a useful application in other types of constructions differing from the types described above.

While the invention has been illustrated and described as embodied in a multi-zone gas detection system, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A gas detection system for use in multiple zones, comprising:

a) a plurality of gas sensor assemblies for placing in the multiple zones and for detecting gas thereat; each gas sensor assembly being for mounting on a ceiling, since the gas is lighter than air and rises; each gas sensor assembly comprising a sensor housing; said sensor housing being thin and cylindrically-shaped, and having:

i) a sensor upper terminal surface being substantially flat and circular-shaped for contacting the ceiling;

ii) a sensor lower terminal surface being substantially flat and circular-shaped; said sensor lower terminal surface having:

1) a plurality of bottom vents extending therethrough for receiving the gas; and 2) a bottom grill being gas permeable and covering said plurality of bottom vents for preventing entrance of undesirable objects therethrough;

iii) a sensor side wall being ring-shaped and extending from said sensor upper terminal surface to said sensor lower terminal surface; said sensor side wall having:

1) a plurality of side vents extending therethrough for receiving the gas; and 2) a side grill being gas permeable and covering said plurality of side vents for preventing entrance of undesirable objects therethrough;

b) a central control operatively connected to said plurality of gas sensor assemblies; and c) an alarm responsive to any of said plurality of gas sensor assemblies detecting the gas.

2. The system as defined in claim 1, wherein each gas sensor assembly is for mounting on a ceiling, since the gas is lighter than air and rises.

3. The system as defined in claim 1, wherein each gas sensor assembly further comprises a gas sensor that is disposed in said sensor housing for detecting the gas.

4. The system as defined in claim 3, wherein said central control comprises a control housing that has a front face.

5. The system as defined in claim 4, wherein said alarm comprises a plurality of indicator lights that are disposed on said front face of said control housing, with a respective indicator light being in electrical communication with an associated gas sensor so as to allow said respective indicator light to illuminate when said associated gas sensor detects the gas and provide a visible alarm that is detected from a central location remote from the plurality of gas sensor assemblies.

6. The system as defined in claim 5, wherein said alarm further comprises indicia that is disposed along side said plurality of indicator lights and associates said respective indicator light with said associated gas sensor assembly so as to allow identification of which zone the gas has been detected in.

7. The system as defined in claim 3, wherein said alarm comprises a sound generator that is disposed on said sensor lower terminal surface of each said sensor housing, with a respective said sound generator being in electrical communication with an associated gas sensor so as to allow said respective sound generator to activate when said associated gas sensor detects the gas and provide an audible alarm that is detected at said associated gas sensor.

8. The system as defined in claim 7, wherein said central control comprises an internal test circuit that periodically tests operation of said gas sensors, and if the test fails, activates an associated sound card.

9. The system as defined in claim 3, wherein said central control comprises an internal ventilator circuit for operatively connecting to and turning on a ventilation system in a zone when an associated gas sensor detects the gas.

10. The system as defined in claim 1, wherein said alarm further comprises first apparatus for being operatively connected to a gas main valve and closing the gas main valve when said alarm is activated so as to prevent any more gas from escaping.

11. The system as defined in claim 1, wherein said alarm further comprises second apparatus for being operatively connected to a telephone communication line and automatically dialing out a distress call when said alarm is activated so as to facilitate corrective action.

* * * * *